US007082972B1

(12) United States Patent
Healy

(10) Patent No.: US 7,082,972 B1
(45) Date of Patent: Aug. 1, 2006

(54) FUEL DELIVERY NOZZLE

(75) Inventor: James W. Healy, Hollis, NH (US)

(73) Assignee: Healy Systems, Inc., Hudson, NH (US)

( * ) Notice: Subject to any disclaimer, the term of this patent is extended or adjusted under 35 U.S.C. 154(b) by 0 days.

(21) Appl. No.: 11/107,288

(22) Filed: Apr. 15, 2005

(51) Int. Cl.
*B65B 1/30* (2006.01)

(52) U.S. Cl. ..... 141/215; 141/192; 141/206; 141/387; 141/392

(58) Field of Classification Search ..... 141/206–218, 141/351–353, 360–362, 387, 392
See application file for complete search history.

(56) References Cited

U.S. PATENT DOCUMENTS

| | | | | |
|---|---|---|---|---|
| 3,881,528 | A * | 5/1975 | Mackenzie | 141/52 |
| 4,658,987 | A | 4/1987 | Fink, Jr. | |
| 5,121,777 | A * | 6/1992 | Leininger et al. | 141/207 |
| 5,127,451 | A | 7/1992 | Fink, Jr. et al. | |
| 5,394,909 | A | 3/1995 | Mitchell et al. | |
| 5,609,192 | A * | 3/1997 | Anderson et al. | 141/208 |
| 6,585,014 | B1 | 7/2003 | Fink, Jr. | |

* cited by examiner

*Primary Examiner*—Timothy L. Maust
(74) *Attorney, Agent, or Firm*—Fish & Richardson P.C.

(57) ABSTRACT

A fuel dispensing nozzle has a body with a spout, which together define a passageway for flow of fuel from a hose connected to a fuel dispenser, through the spout, and into a vehicle fuel tank fill pipe. A boot surrounding the spout defines an outer rim that engages a surface surrounding the fill pipe. A valve within the nozzle body starts and stops flow of fuel through the passageway. An anti-spitting lockout assembly resists opening of the valve, but a linkage mechanism triggers release of the lockout assembly when the boot rim engages the surface surrounding the fill pipe, signaling insertion of the spout into the fill pipe, to permit actuation of valve. In a preferred implementation, the anti-spitting lockout assembly resists opening of the valve to permit flow of fuel through the passageway to the spout until the boot rim engages the surface surrounding the fill pipe, signaling insertion of the spout, thereby to prevent spitting of liquid fuel from the spout due to premature release of liquid fuel held under residual pressure in the hose. A fuel dispenser assembly including this fuel dispensing nozzle is also described.

19 Claims, 8 Drawing Sheets

FUEL DELIVERY NOZZLE

TECHNICAL FIELD

This document relates to vehicle fuel dispensing systems and to nozzles for such systems.

BACKGROUND

Fuel dispensing nozzles and devices for recovery of vapor displaced during delivery of fuel, and, in particular, fuel dispensing nozzles having the feature of vapor recovery and/or vapor flow control assemblies for use with such nozzles, are described, e.g., in commonly owned U.S. Pat. Nos. 4,056,131, 4,057,086, 4,343,337, 5,174,346, 5,178,197, 5,327,944 and 6,095,204. The entire disclosures of all of these patents are incorporated herein by reference.

During the process of sequential fueling of a stream of vehicles at a gasoline service station, residual pressure from termination of gasoline flow by the dispenser nozzle at the conclusion of fueling of a first vehicle can result in expansion of the flexible curb hose. When preparing to fuel the next vehicle, if the user lifts the nozzle operating lever while the hose remains pressurized and before the nozzle spout is inserted into the fuel fill pipe, contraction of the flexible hose to relieve internal, residual pressure can cause release or "spitting" of fuel, even if the dispenser has not been authorized for delivery of gasoline.

In Phase II vapor recovery stations equipped with balance vapor recovery nozzles, this problem is absent, since these nozzles have a "no seal/no flow" feature that restricts the operating lever of the nozzle from lifting the fuel valve, thus avoiding spitting. The primary reason for the "no seal/no flow" feature is to insure that the nozzle is in sealing engagement with the vehicle fill pipe before fueling commences, thereby to enhance vapor recovery efficiency. The resulting non-spitting feature of these nozzles is important to the California Air Resources Board (CARB) for protection of self-service customers and for improving air quality. In light of the above, CARB now requires that all vapor recovery nozzles demonstrate the ability to prevent spitting when the nozzle lever is lifted prior to proper insertion of the nozzle spout in a vehicle fill pipe. The CARB test procedure is described in the Phase II regulations under TP-201.2E entitled "Liquid Retention."

SUMMARY

According to one aspect, a fuel dispensing nozzle has a nozzle body with a liquid fuel delivery spout, the nozzle body and the spout together defining a passageway in communication with a hose connected to a fuel dispenser for delivery of liquid fuel from the dispenser, through the spout, and into a fill pipe of a vehicle fuel tank; a boot surrounding the spout and defining a boot outer rim disposed for engagement with a surface surrounding the fill pipe; a fuel valve disposed within the nozzle body for starting and stopping flow of liquid fuel through the passageway; an anti-spitting lockout assembly for resisting opening of the fuel valve for flow of liquid fuel through the passageway; and a linkage mechanism for triggering release of the anti-spitting lockout assembly when the boot outer rim is engaged with the surface surrounding the fill pipe, signaling insertion of the spout into a vehicle fill pipe, to permit actuation of the fuel valve.

Preferred implementations may include one or more of the following additional features. The anti-spitting lockout assembly is adapted to resist opening of the fuel valve for flow of liquid fuel through the passageway to the spout until the boot outer rim is engaged with the surface surrounding the fill pipe, signaling insertion of the spout into a vehicle fill pipe, thereby to resist spitting of liquid fuel from the spout due to premature release of liquid fuel held under residual pressure in the hose. In the presence of authorization of an associated fuel dispenser for delivery of liquid fuel to the fuel dispensing nozzle, the anti-spitting lockout assembly is adapted to resist opening of the fuel valve to permit flow of liquid fuel through the passageway to the spout until the boot outer rim is engaged with the surface surrounding the fill pipe, signaling insertion of the spout into a vehicle fill pipe, thereby to resist spitting of liquid fuel from the spout. The boot is axially-compressible, and compression of the boot by engagement of the boot outer rim with the surface surrounding the fill pipe by insertion of the spout into the fill pipe is communicated by the linkage mechanism to the anti-spitting lockout assembly to trigger release of the fuel valve. The boot defines a series of convolutions, and the linkage assembly includes a boot push plate member disposed within a convolution of the boot. The anti-spitting lockout assembly includes a lift cam arm pivotably mounted for movement between a first, lockout position and a second, release position, and the linkage assembly further has linkage elements in communication between the boot push plate member and the lift cam arm for triggering movement of the lift cam arm between the first position and the second position in response to movement of the boot push plate member due to compression of the boot when the boot outer rim is engaged with the surface surrounding the fill pipe, signaling insertion of the spout into a vehicle fill pipe. The lift cam arm is spring-biased toward the first, lockout position.

According to another aspect, a boot assembly for a fuel dispensing nozzle comprises an axially-compressible boot with a boot outer rim for mounting about a nozzle spout, and components of a linkage mechanism for communicating compression of the boot by engagement with a surface surrounding a vehicle fill pipe, signaling insertion of the spout into the vehicle fill pipe, to trigger release of an anti-spitting lockout assembly that prevents opening of a fuel valve for flow of liquid fuel toward the spout.

In a preferred implementation, the axially-compressible boot defines a series of convolutions, and the components of a linkage assembly comprise a boot push plate member disposed in a boot convolution and at least one linkage element. The boot push plate member is loosely mounted in the axially-compressible boot, in a manner to permit rotational adjustment of the boot relative to the boot push plate member. Preferably, the boot is fully rotatable relative to the boot push plate and to the associated nozzle. The components of a linkage assembly further comprise a connecting push plate member pivotably mounted to the spout assembly for communication between linkage elements of the boot assembly and linkage elements of the associated nozzle.

According to yet another aspect, a fuel dispenser assembly includes a fuel dispenser in communication with a source of liquid fuel, a fuel dispensing nozzle, and a hose in communication between the fuel dispenser and the fuel dispensing nozzle for delivery of liquid fuel from the fuel dispenser to the fuel dispensing nozzle. The fuel dispensing nozzle has a nozzle body with a liquid fuel delivery spout, which together define a passageway in communication with the hose for delivery of liquid fuel from the dispenser, through the spout, and into a fill pipe of a vehicle fuel tank; a boot surrounding the spout and defining a boot outer rim disposed for engagement with a surface surrounding the fill pipe; a fuel valve disposed within the nozzle body for starting and stopping flow of liquid fuel through the passageway; an anti-spitting lockout assembly for resisting opening of the fuel valve for flow of liquid fuel through the passageway; and a linkage mechanism for triggering release of the anti-spitting lockout assembly when the boot outer rim is engaged with the surface surrounding the fill pipe, signaling insertion of the spout into a vehicle fill pipe, to permit actuation of the fuel valve.

Preferred implementations of this aspect may include one or more of the following additional features. The anti-spitting lockout assembly is adapted to resist opening of the fuel valve for flow of liquid fuel through the passageway toward the spout until the boot outer rim is engaged with the surface surrounding the fill pipe, signaling insertion of the spout into a vehicle fill pipe, thereby to resist spitting of liquid fuel from the spout due to premature release of liquid fuel held under residual pressure in the hose. In the presence of authorization of an associated fuel dispenser for delivery of liquid fuel to the fuel dispensing nozzle, the anti-spitting lockout assembly is adapted to resist opening of the fuel valve to permit flow of liquid fuel through the passageway to the spout until the boot outer rim is engaged with the surface surrounding the fill pipe, signaling insertion of the spout into a vehicle fill pipe, thereby to resist spitting of liquid fuel from the spout. The boot is axially-compressible, and compression of the boot by engagement of the boot outer rim with the surface surrounding the fill pipe by insertion of the spout into the fill pipe is communicated by the linkage mechanism to the anti-spitting lockout assembly to trigger release of the fuel valve. The boot defines a series of convolutions, and the linkage assembly comprises a boot push plate member disposed within a convolution of the boot. The anti-spitting lockout assembly includes a lift cam arm pivotably mounted for movement between a first, lockout position and a second, release position, and the linkage assembly further has linkage elements in communication between the boot push plate member and the lift cam arm for triggering movement of the lift cam arm between the first position and the second position in response to movement of the boot push plate member in response to compression of the boot when the boot outer rim is engaged with the surface surrounding the fill pipe, signaling insertion of the spout into a vehicle fill pipe. The lift cam arm is spring-biased toward the first, lockout position. The linkage elements comprise a connecting push plate member mounted for communication between linkage elements of the boot and of the fuel dispensing nozzle. The connecting push plate member is pivotably mounted to the spout assembly.

The details of one or more implementations are set forth in the accompanying drawings and the description below. Other features, objects, and advantages will be apparent from the description and drawings, and from the claims.

DESCRIPTION OF DRAWINGS

FIG. 7 is a somewhat diagrammatic side section view of the diaphragm and latch pin region of the nozzle assembly, with the diaphragm and latch pin assembly in lower position for engagement of the ball latch to permit actuation of main fuel valve, while

Like reference symbols in the various drawings indicate like elements.

DETAILED DESCRIPTION

Figure 1:
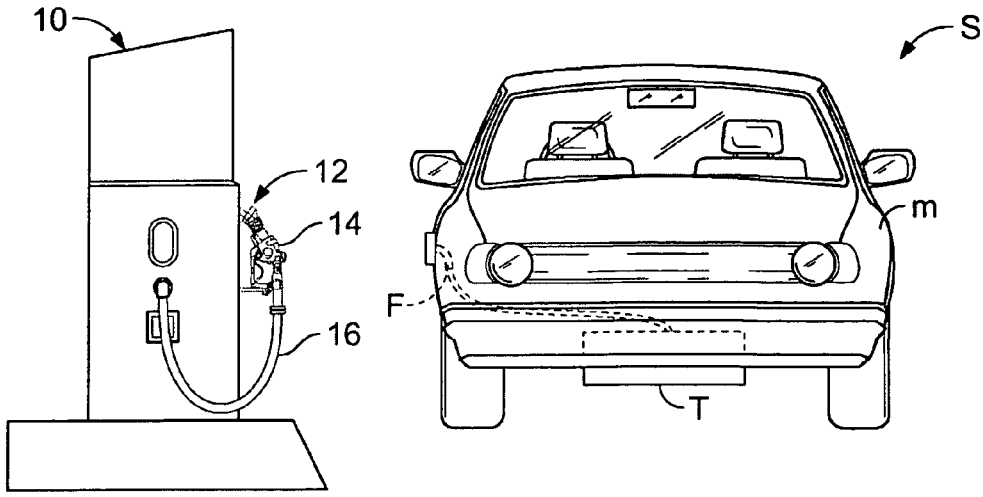
FIGS. 1 and 2 are somewhat diagrammatic front and side views, respectively, of a motor vehicle positioned adjacent a fuel dispenser for receiving fuel.
Figure 2:
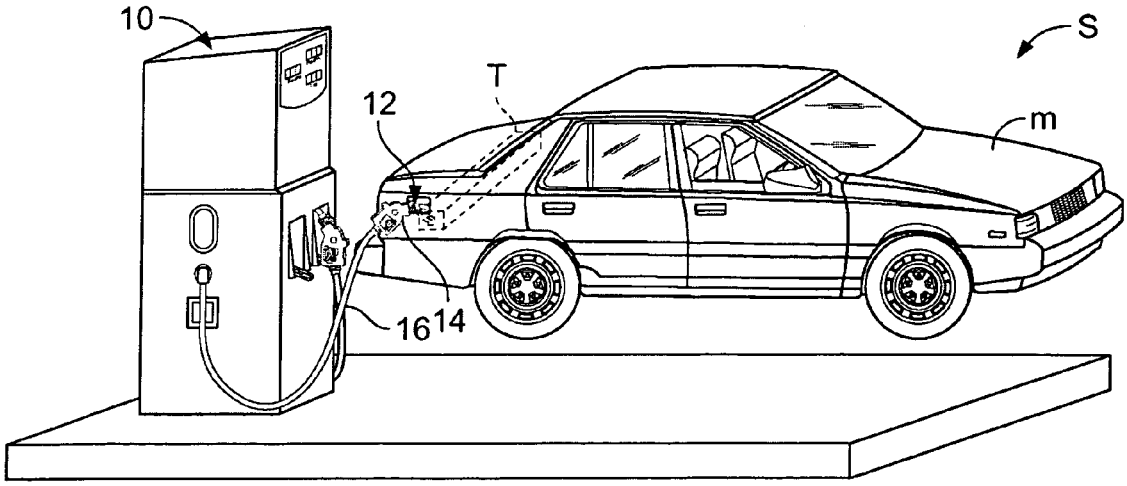
Figure 3:
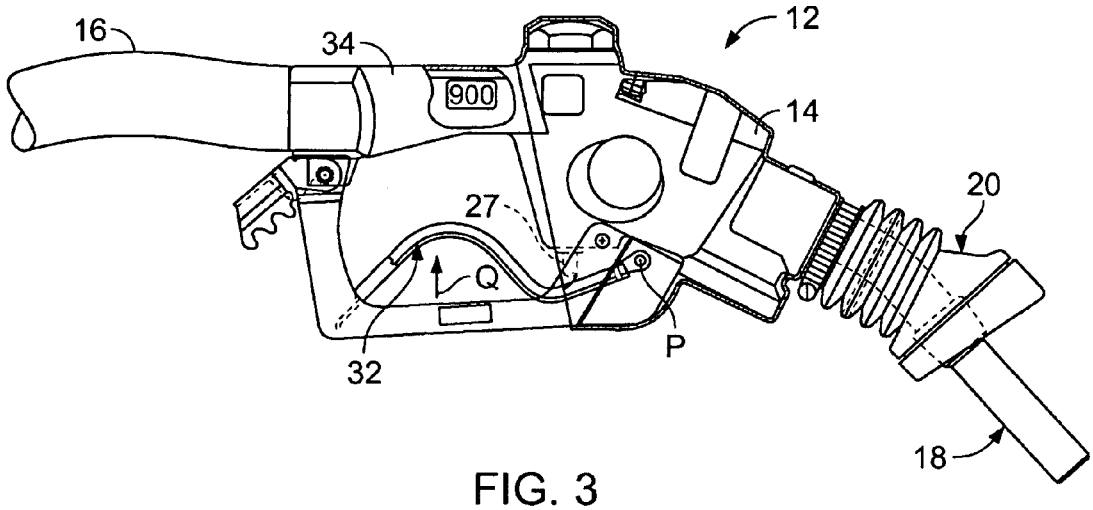
FIG. 3 is a side view of fuel dispensing nozzle assembly equipped to restrict flow of fuel, e.g. due to residual pressure in the hose, until the nozzle spout is properly inserted into a motor vehicle fill pipe.

Referring to FIGS. 1 and 2, at a gasoline service station, S, a motor vehicle, M, is positioned for delivery of liquid fuel (gasoline) from a fuel dispenser 10 into the vehicle's fill pipe, F, leading to its vehicle fuel tank, T. Referring also to FIG. 3, a fuel dispensing nozzle assembly 12, is shown holstered to the fuel dispenser 10 in FIG. 1 and engaged in the vehicle fill pipe in FIG. 2. The nozzle assembly has a nozzle body 14, formed, e.g., of aluminum, connected to the fuel dispenser by a fuel hose 16. A spout assembly 18 extends from the nozzle body 14, surrounded by an axially compressible boot 20.

Figure 4:
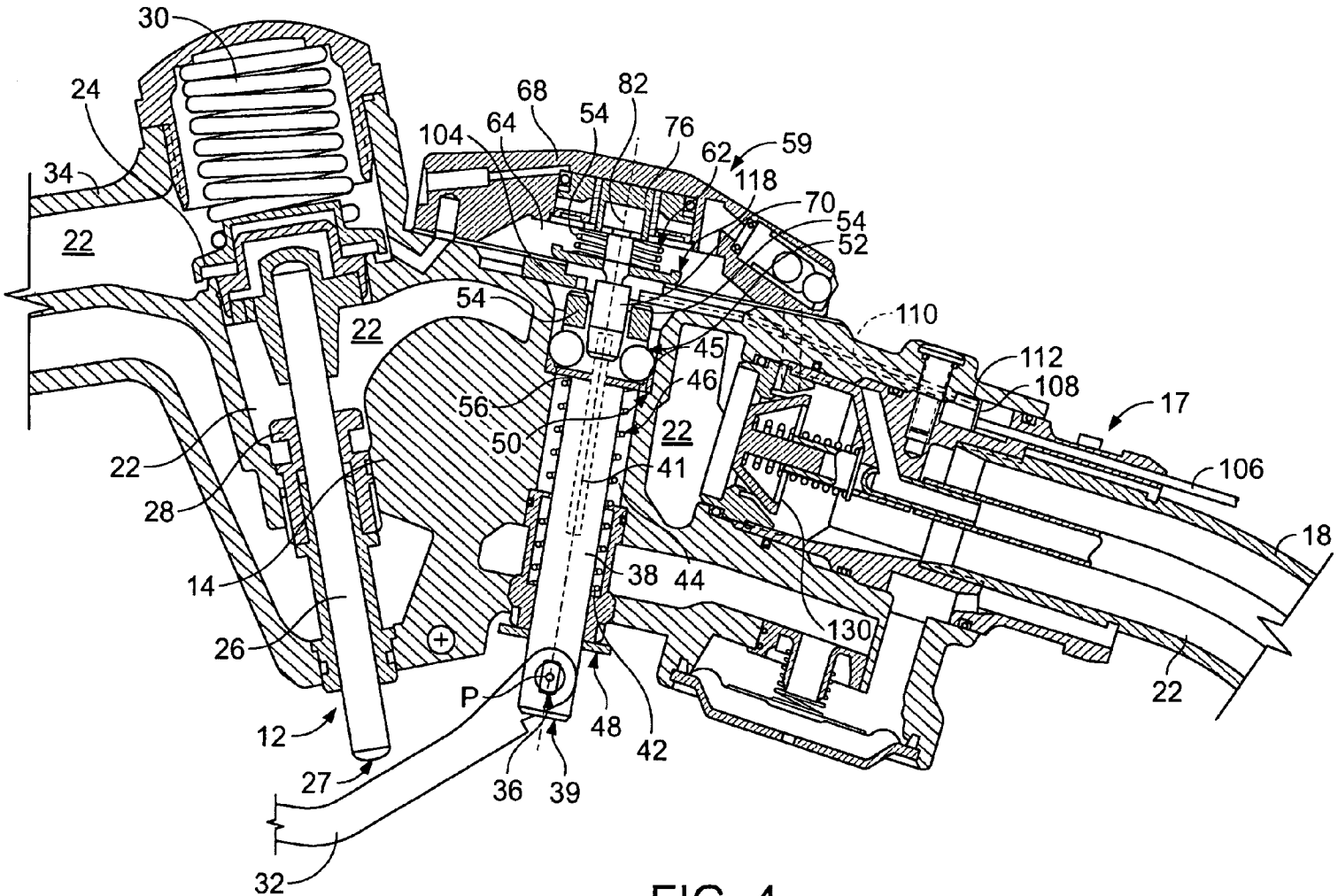
FIG. 4 is a side section view of a portion of the fuel dispensing nozzle assembly valve of FIG. 3.

Referring now also to FIG. 4, the nozzle body 14 and spout 18 together define a passageway 22 for flow of liquid fuel from the fuel dispenser 10, through hose 16 and fuel passageway 22 of the nozzle 14 and spout 18, into the vehicle fill pipe, F, of the motor vehicle, M (FIGS. 1 and 2). Flow of fuel through the passageway 22 is controlled by the main fuel valve 24 mounted at the upper end of valve stem 26. The valve stem 26 is mounted for axial movement within the nozzle body 14 relative to the stem seal body 28 fixedly mounted in the nozzle body 14. Main valve spring 30 urges the main fuel valve 24 closed. The main fuel valve 24 is opened by squeezing or lifting operating lever 32 towards the nozzle handle 34, causing the operating lever 32 to pivot about axis, P, of lever pin 36, which secures the operating lever 32 to the outer end 39 of forward pivot rod 38, extending in telescoping relationship from a lower rod portion 41 of latch pin assembly 40. As the operating lever 32 pivots, it engages (and lifts) the exposed end 27 of the valve stem 26 in a manner to actuate (open) the main fuel valve 24, subject to other conditions, as will be discussed below.

The forward pivot rod 38, slideably disposed in nozzle body bore 44, has its outer end 39 extending from the nozzle body through orifice 42 in sleeve 48. A plunger latch spring 46 extends between the sleeve 48, fixed to the nozzle body, and the undersurface 56 of a ball chamber 54, fixedly mounted atop the forward pivot rod 38, to lift the forward pivot rod into the nozzle body bore 44. A number of balls 52, e.g. three, are disposed in the ball chamber 54 and arrayed about the latch pin assembly 40. A latch ring 50, engaged with a shoulder 45 of the nozzle body bore 44 where it narrows from an upper region to a lower region, has a sloped inner surface that directs the balls 52 inwardly, towards the surface of latch pin assembly 40.

Figure 5:
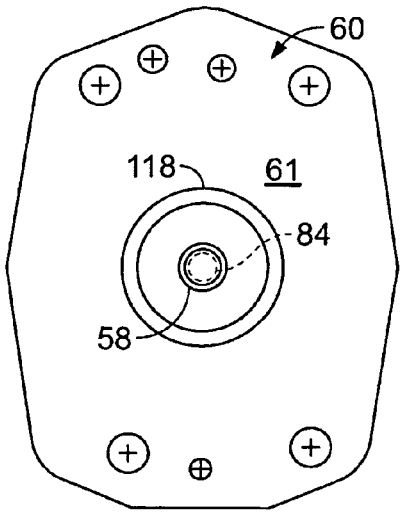
FIGS. 5 and 6 are a top view and a side view, partially in section, respectively, of a diaphragm and latch pin assembly in the fuel dispensing nozzle of FIG. 3.
Figure 6:
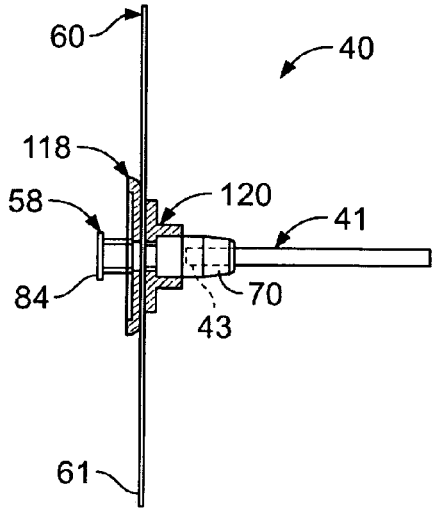

Referring to FIGS. 5 and 6, latch pin assembly 40 includes lower rod portion 41, which is disposed in co-axial, sliding, telescoping relationship with forward pivot rod 38 (FIG. 4). The upper end of the lower rod portion 41 is engaged with conical tapered body 70, which in turn is engaged with spacer 120. A lift nut 58, disposed at the upper surface of the washer 118, is in threaded engagement with the upper end of the conical tapered body 70, which extends through washer 118, the diaphragm 60 and the spacer 120, of the latch pin assembly 40.

Referring again to FIGS. 4–8, compression spring 62, disposed in a chamber 64 defined between the diaphragm upper surface 61 and the washer 86 of the diaphragm assembly 59, and engaged between the cover 68 and the washer 118, aids in positioning the latch pin assembly 40 and the diaphragm 60 at rest.

Referring now again to FIGS. 4–8, when the conical, tapered portion 70 of the latch pin assembly 40 is in a lowered position (FIG. 7), the balls 52 in ball chamber 54 are in latching engagement between the latch ring 50 and the opposed surface of the conical tapered portion 70, securing the position of the ball chamber 54 and the attached forward pivot rod 38. With the conical tapered body 70 engaged upon the balls 52, the forward pivot rod 38 is fixed axially, which permits actuation of the main fuel valve 24. Squeezing pressure (arrow, Q, in FIG. 3) applied against the operating lever 32 acts to lift the valve stem 26 to open the main fuel valve 24.

Figure 8:
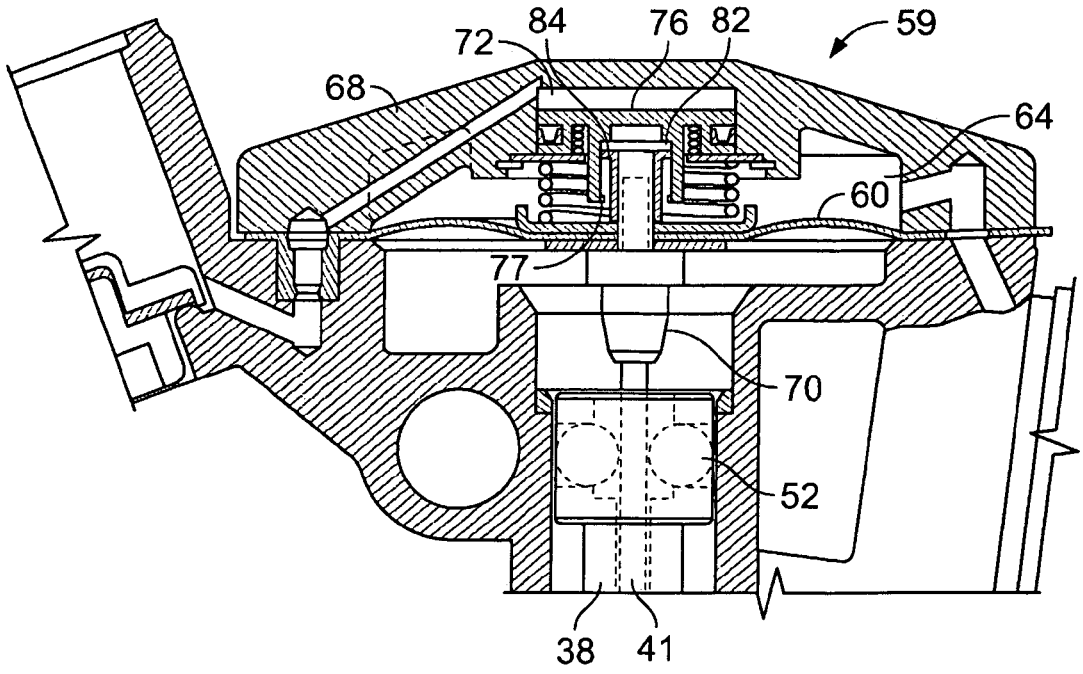
FIG. 8 is a similar somewhat diagrammatic side section view of the diaphragm and latch pin region of the nozzle assembly, with the diaphragm and latch pin assembly in raised position for preventing engagement of the ball latch to resist actuation of main fuel valve.

In contrast, the presence of a high vacuum pressure condition in the chamber 64 at the upper surface 61 of the diaphragm 60, caused, e.g., when the fill pipe, F, of the motor vehicle, M, being refueled is full of fuel or the tank, T, is being filled too fast, the diaphragm 60 is drawn upwards, and latch pin assembly 40 is lifted towards its upper position, raising the conical tapered body 70 from engagement with the balls 52 (FIG. 8). With the conical, tapered portion 70 of the latch pin assembly 40 in raised position, spaced from engagement with the balls 52, the balls in the ball chamber 54, directed inward by the latch ring 50, allow the forward pivot rod 38 a range of axial movement. The forward pivot rod 38 is thus released to be drawn from the nozzle body bore 44 against the pressure of spring 46, and without pivot pressure applied to lift the exposed end 27 of the valve stem 26, the main fuel valve 24 is prevented from opening against the force of spring 30. Squeezing pressure (arrow, Q) applied to the operating lever 32 simply draws the forward pivot rod 38 from the nozzle body 14 without being able to lift the valve stem 26 to open the main fuel valve 24, as described in my earlier patents, as listed above.

Referring again to FIGS. 7 and 8, and also as described in my earlier patent, U.S. Pat. No. 5,178,197, the diaphragm 60, and attached latch pin assembly 40, may also be held in the upper position unless fuel at relatively high pressure (i.e. at least about 8 psi) is present in the cylindrical region 72 defined by cover 68 of the diaphragm housing 59 and piston 76, which is disposed in sliding engagement with the surrounding wall, sealed by u-cup seal 80. The piston 76 is mounted to move co-axially with respect to the diaphragm 60 and normally held against the cover 68 by spring 78, supported by washer 86. A circumferential flange 84 extending radially outward at the top of the lift nut 58 of the latch pin assembly 40 is engaged with sliding fit within region 82, defined by a downward extension of the piston.

When pressure of fuel within the cylindrical region 72 above piston 76 is at relatively low positive pressure (e.g., approximately 4 psi or less), the spring 78 urges the piston 76 upwards, with a circumferential flange 77 extending radially inwardly from a lower extension of the piston 76 to engage with flange 84 of the lift nut 58 of the latch pin assembly 40 and thus hold the conical tapered body 70 of latch pin assembly 40 in raised position, out of engagement with the balls. The balls 52 are then free to move inwardly, and therefore are not in position for latching engagement of the forward pivot rod 38. As a result, pressure on the operating lever 32 draws the forward pivot rod 38 from the nozzle body 14 without permitting application of pressure necessary for lifting the end 27 of the valve stem 26, as required for opening of the fuel valve 24.

Once the fuel dispenser 10 has been authorized for delivery of fuel to the nozzle 12, the fuel passageway 22 of nozzle assembly 12 is opened for flow of fuel by squeezing the operating lever 32 towards the nozzle handle 34, the lever 32 being mounted to pivot about point, P, at the end of forward pivot rod 38 slidingly mounted to latch pin assembly 40. The operating lever 32 engages the exposed end 27 of the valve stem 26 to lift the valve stem 26 against the force of spring 30, opening the main fuel valve 24 (FIG. 4). However, the main fuel valve assembly 24 can be opened only if the latch pin assembly 40 is displaced towards its lower position so the conical tapered body 70 is engaged by the balls 52. This requires deflection of the diaphragm 60 downward, e.g. by relatively high pressure fuel (i.e. at least about 8 psi) from the fuel delivery line 22 detected in cylindrical region 72.

Figure 7:
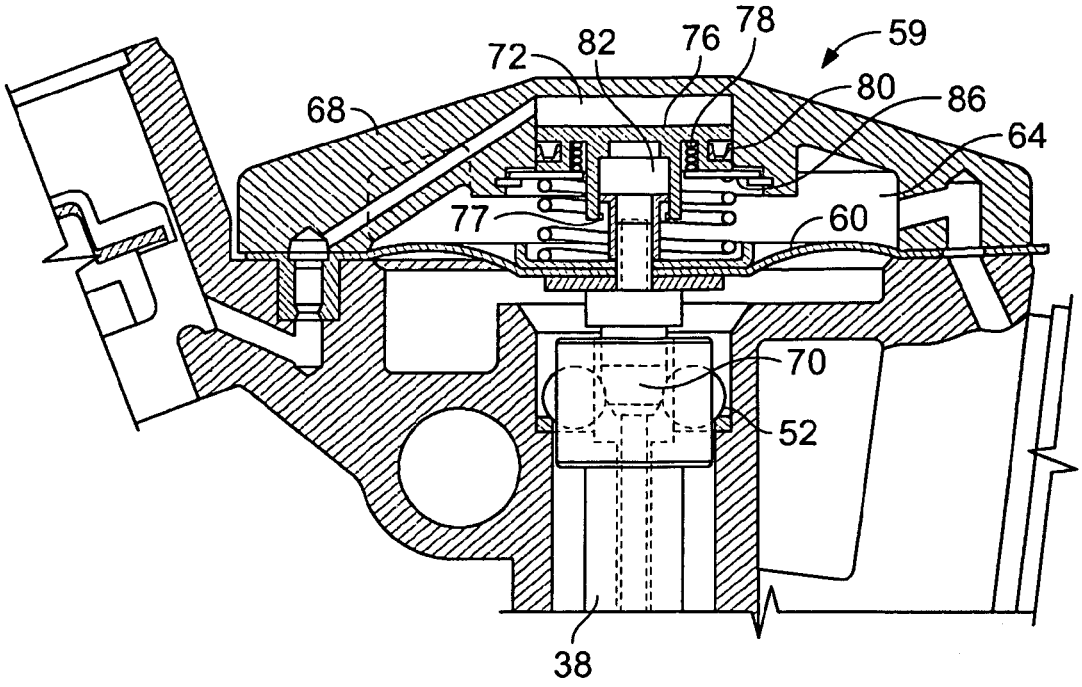

When relatively high pressure fuel (approximately 8 psi or more) is applied to cylindrical region 72 above piston 76, the piston is urged downward, compressing spring 78 (FIG. 7), thus releasing the latch pin assembly 40 for downward movement under influence of the spring 62, which sets the "at rest" position of the diaphragm 60. At this point, as illustrated in FIG. 7, the balls 52 are in latching position, engaged with the surface of the tapering, conical body 70 of the latch pin assembly 40 and latch ring 50, to prevent release of the forward pivot rod 38. With the tapering conical body 70 of the latch pin assembly 40 engaged with balls 52, squeezing pressure (arrow, Q) on the operating lever 32 towards the nozzle handle 34 lifts the valve stem 26 against spring 30 to open the main fuel valve 24.

Referring once again to FIGS. 1, 2 and 4, the present implementation of the nozzle assembly 12 is directed to restricting opening of the main fuel valve 24 before the nozzle spout 18 is engaged in the vehicle fill pipe, F, e.g. to reduce or prevent spitting of liquid fuel caused by release of liquid fuel under residual pressure due to expansion of the fuel hose 16, the spitting a result of premature opening of the fuel valve 24 before the nozzle spout 18 is inserted.

Figure 9:
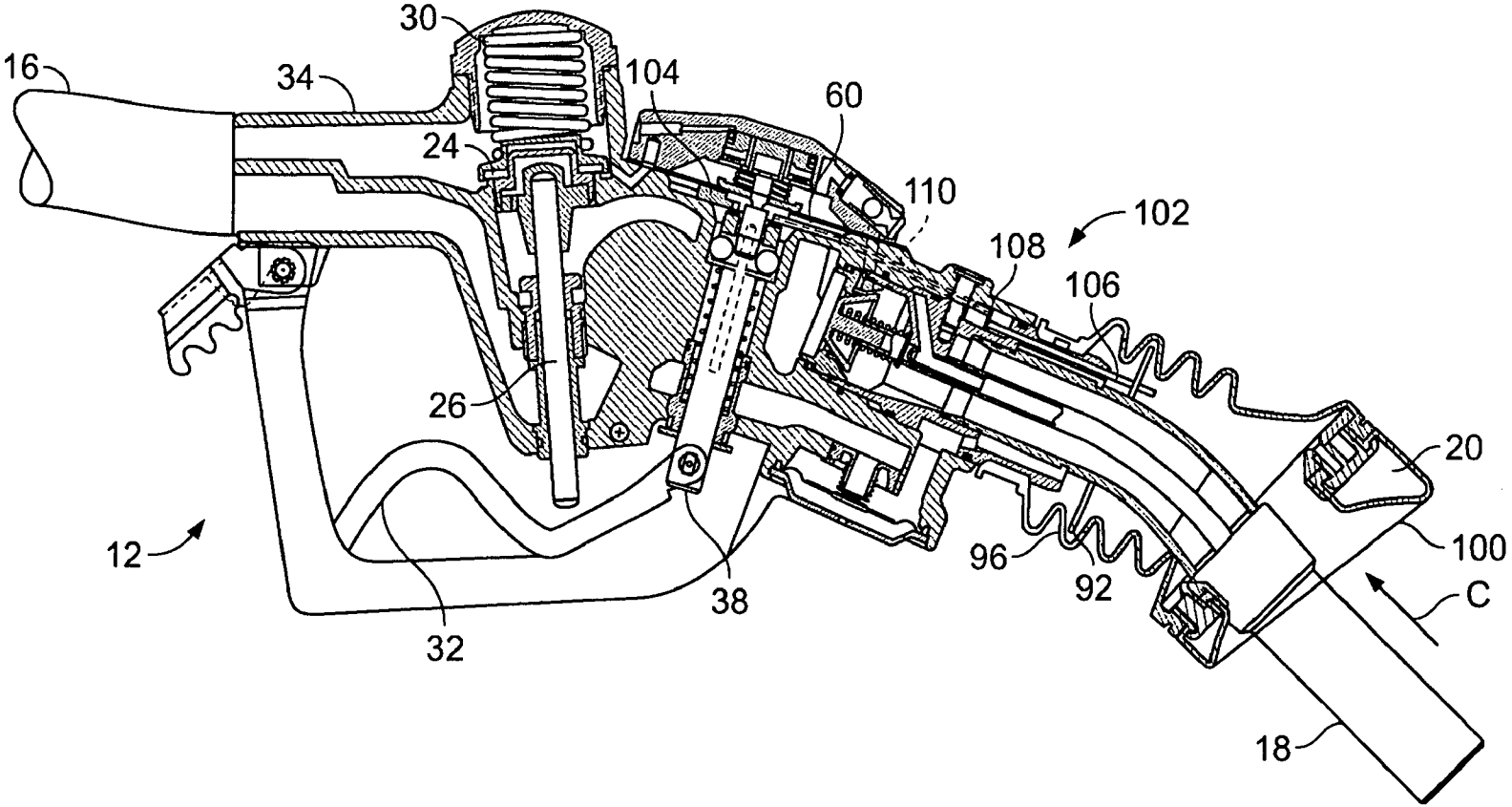
FIG. 9 is a somewhat diagrammatic side view of a nozzle assembly equipped with an anti-spitting lockout assembly.
Figure 10:
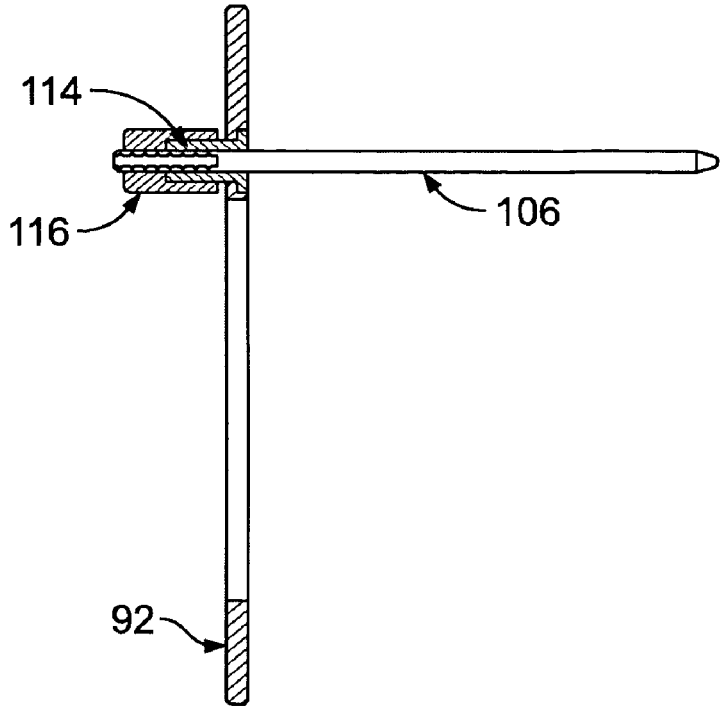
FIG. 10 is a side section view of the boot push plate and lower push rod assembly of the anti-spitting lockout assembly.

Referring now also to FIGS. 9 and 10, an anti-spitting lockout assembly 90 includes a boot push plate 92 positioned within convolutions of the compressible boot 20 surrounding the nozzle spout 18. Preferably, the boot push plate 92 is disposed within a second convolution 96 from the first end 98 (FIG. 15) of the boot 20. When the nozzle spout 18 is inserted into the vehicle fill pipe, F, the boot outer rim sealing surface 100 engages against the surface, V, of the vehicle, M. Pressure of the boot rim 100 against the vehicle surface, V (represented in dashed line in FIG. 15), serves to compress the boot 20, displacing the boot push plate 92 axially along the spout 18 towards the nozzle body 14. This displacement of the boot push plate 92 is communicated by a linkage assembly 102 from the boot push plate 92 to a lift cam arm 104. The linkage assembly 102 extends between and operably links the boot 20 with the region of the latch pin assembly 40 and diaphragm 60, contained within the nozzle body 14. The linkage assembly 102 includes a lower push rod 106 having a first (outer) end attached to boot push plate 92 disposed within the boot 20. A second (inner) end of the lower push rod 106 is associated with, i.e. engaged upon a first surface of, a connecting push plate 108, which is pivotably mounted to the spout assembly 17. An upper push rod 110, extending through a guide tube pathway 112 defined by the nozzle body 14, has a first (outer) end engaged with an opposite, second surface of the connecting push plate 108 and is associated at its second (inner) end with lift cam arm 104. Referring now also to FIG. 10, in the anti-spitting lockout assembly 90, the lower push rod 106 is joined to the boot push plate 92 at a push collar 114 by threaded engagement at an orientation normal to the boot push plate 92. A pull collar 116 is joined to the push collar 114 by threaded engagement of the pull collar 116 over the push collar 114 and secured with an adhesive, e.g. LOCTITE®, for enhanced bonding. The boot push plate 92 is thus designed to communicate axial movement due to compression of the boot 20 to accomplish pivoting motion of the lift cam arm 104 between first (engaged) and second (retracted) positions, as described below.

Figure 11:
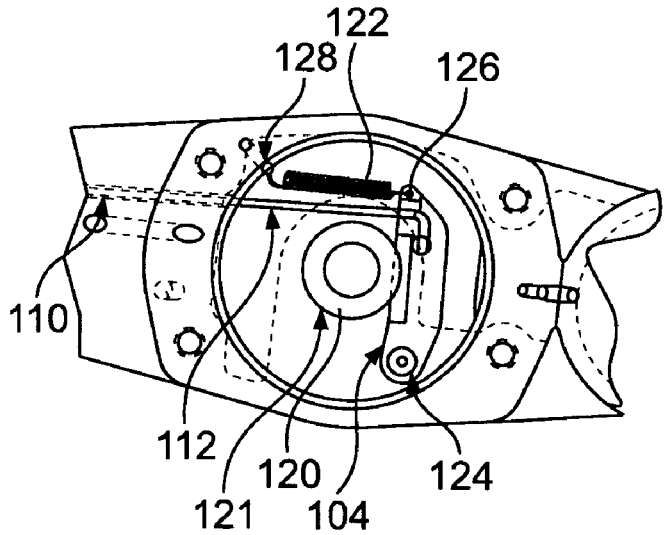
FIG. 11 is a plan view of the anti-spitting lockout assembly mounted in the nozzle under the diaphragm and the washer of the latch pin assembly, showing the lift cam arm of the anti-spitting lockout assembly in the first (engaged) position.

Referring once again to FIG. 4 and also to FIG. 11, as the latch pin assembly 40 is moved upward, the conical tapered body 70 is removed from engagement with the balls 52, leaving only the narrower, lower portion 41 of the latch pin assembly 40 extending through the ball chamber 54. This permits the balls 52 to pass downward, past the latch ring 50, releasing the forward pivot rod 38 to move downwardly and release the end of the operating lever 32. Since the operating lever 32 cannot lift the valve stem 26, spring 30 urges the valve stem 26 downward to keep the main fuel valve assembly 24 closed, thus preventing flow of fuel to the nozzle 18.

Figure 12:
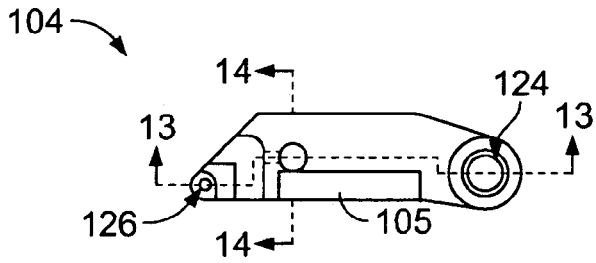
FIG. 12 is a top plan view.
Figure 13:
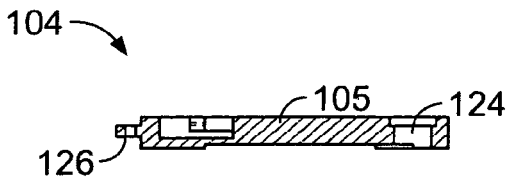
FIG. 13 is a side section view, taken at the line 13—13 of FIG. 12.
Figure 14:
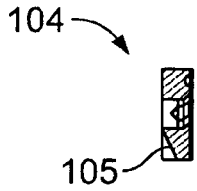
FIG. 14 is an end section view, taken at the line 14—14 of FIG. 12, of the lift cam arm.

Referring now also to FIG. 11, the lift cam arm 104 mounted beneath the diaphragm 60 moves between a first position engaging and lifting the spacer 120 and a second position removed from engagement. When the lift cam arm 104 is engaged, the diaphragm 60 and attached latch pin assembly 40 are restricted from downward movement. Opening of the main fuel valve 24 is prevented while the lift cam arm 104 is thus engaged. The lift cam arm 104 is urged into its first, engagement position by spring 122. Referring also to FIGS. 12, 13, and 14, the lift cam arm 104 is pivotably mounted at a pivot bushing 124 located at a first end. The spring 122, urging the lift cam arm towards its engaged position, extends between a hole 126 defined at a second end of the lift cam arm 104 and a hook 128. The lift cam arm 104 defines an angled leading edge 105 along the top surface of the lift cam arm 104 positioned for lifting engagement with the outer edge 121 of the spacer 120 of the latch pin assembly 40 (FIGS. 5 and 6).

Referring now once again to FIGS. 1–14, if the nozzle assembly 14 is removed from the dispenser 10 and the operating lever 32 is squeezed (arrow, Q) towards the handle 34, the anti-spitting lockout assembly 90 alone, and/or with other lockout features of the nozzle assembly 12, prevents opening of the main fuel valve 24, which would allow residual pressure buildup in the hose 16 to cause spillage or spitting of fuel from the nozzle, even without the dispenser 10 being authorized for delivery of fuel.

According to this implementation, the anti-spitting lockout function prevents flow of gasoline from the nozzle assembly 12 unless the boot 20 is compressed by the action of properly inserting the spout assembly 18 into a motor vehicle fill pipe, F.

Insertion of the nozzle spout 18 into the vehicle fill pipe, F, brings the outer rim surface 100 of the boot 20 into contact with the surface, V, surrounding the fill pipe, F, axially compressing the boot 20 (arrow, C, in FIG. 9). Compression of the boot 20 causes proportional movement of the boot push plate 92 positioned within convolution 96 of the boot 20. In particular, the boot push plate 92 is displaced a first distance, $D_1$, when the sealing face 100 of the boot rim travels a second distance, $D_2$, as it is depressed by engagement against the vehicle surface, V, about the fill pipe, F, during insertion of the nozzle spout 18, e.g., the boot 20 may be configured such that first distance, $D_1$, is about one-third of second distance, $D_2$. Movement of the boot push plate 92 moves the linkage assembly 102 of the first rod 106, the pivotably-mounted connecting push plate 108, and the associated second rod 110 towards the lift cam arm 104. The lift cam arm 104 in turn pivots about a pivot bushing 124, against the force of spring 122, to a position clear of the spacer 120. A combination of retraction of the lift cam arm 104 from engagement with the undersurface of the diaphragm spacer 120 and pressure of fuel in the cylindrical region 72 causes downward movement of the diaphragm 60, to which the latch pin 40 is attached, allowing engagement of the ball-latch. Thereafter, squeezing of the operating lever 32 towards the handle 34 pivots the operating lever 32 about the pivot point, P, to lift the valve stem 26 against compression spring 30, opening the main fuel valve 24 to permit delivery of fuel into the vehicle fuel tank, T.

When the nozzle boot assembly 20 returns to its normal, uncompressed state as the spout tube 18 is removed from the vehicle fill pipe, F, extension spring 122 causes counter-rotation of the lift cam arm 104 to raise the diaphragm assembly 60. The cam lifting action occurs when the angled leading edge top surface 105 of the lift cam arm 104 engages the lower peripheral edge of the flange portion of spacer 120 of the diaphragm assembly 60. The balls 52 are thus released from the latched position in engagement with the conical tapered portion 70 of the latch pin assembly 40. The diaphragm 60 is urged upwards, thus lifting and/or securing the latch pin 40 attached thereto in its upper position. This prevents engagement of the ball-latch, which in turn causes the valve stem 26 to be driven downwardly under the force of compression spring 30 associated with the fuel valve 24, since the operating lever 32 is unrestrained at its forward pivot point, P, by the forward pivot rod 38. In this manner, the lockout function described in U.S. Pat. No. 5,178,197 is alternatively, or additionally, achieved with boot compression.

Both gasoline pressure control and boot compression control for elimination of spitting can be employed in the same nozzle. The boot compression method provides effective lock out function control for customer safety and the prevention of damage to the environment obviating the pressure controlled lockout function on nozzles using a vapor recovery boot or splash guard boot to engage the vehicle fill pipe. When applied to assist Phase II-type vapor recovery nozzles with Onboard Refueling Vapor Recovery (ORVR) vehicle detection means as described in U.S. Pat. No. 6,095,204, this feature does not substantially enhance vapor recovery efficiency as does the No Seal/No Flow feature when refueling non-ORVR vehicles but can reduce customer complaints and mitigate additional hydrocarbon pollution of the atmosphere.

Figure 15:
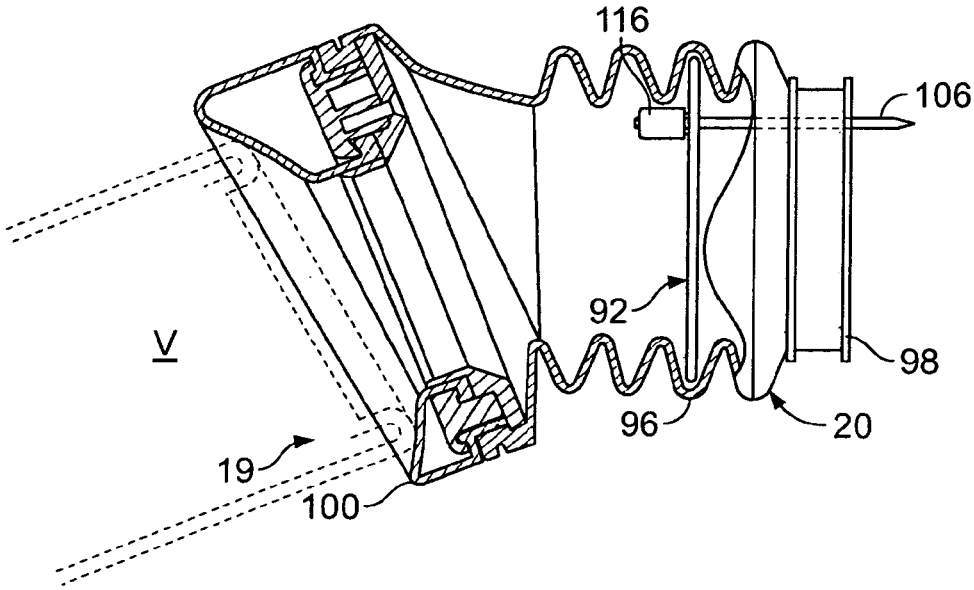
FIG. 15 is a side section view of a replacement boot assembly, with a boot push plate and portion of a linkage assembly.

Referring now to FIG. 15, a nozzle as described herein can provide several other important features. For example, it is common practice in the gasoline service station industry to replace a damaged spout assembly 17 (FIG. 4) and/or boot assembly 19 (FIG. 15) in the field. The boot push plate 92 of the linkage assembly 102 is mounted in a loose fitting state within the second convolution 96 of the boot 20, i.e. the boot is fully rotatable without rotation of the boot push plate (unless the boot is gripped and squeezed in the region of the second convolution to engage the boot upon the boot push plate). The connecting push plate 108 is pivotably mounted to the spout assembly 17. This positioning of the connecting push plate 92, and the loose fit of the boot push plate within the boot, advantageously permits small back and forth rotation of the boot assembly 20 (e.g. ± about 5° clockwise and counterclockwise) during installation, as the boot is worked onto the spout assembly and the linkage assembly components of the boot assembly 19 are placed in communication with the linkage assembly components of the nozzle body 14, e.g. as shown in FIG. 9. The upper push rod 110 is held in a fixed position internal to guide tube pathway 112 in the nozzle assembly 14. Angular freedom between the boot push plate 92 and the connecting push plate 108 (FIG. 16) permits a substantial universal tolerance to manipulation of the boot 20 by the installer while reducing the possibility of inadvertently bending the push rod 106.

Figure 16:
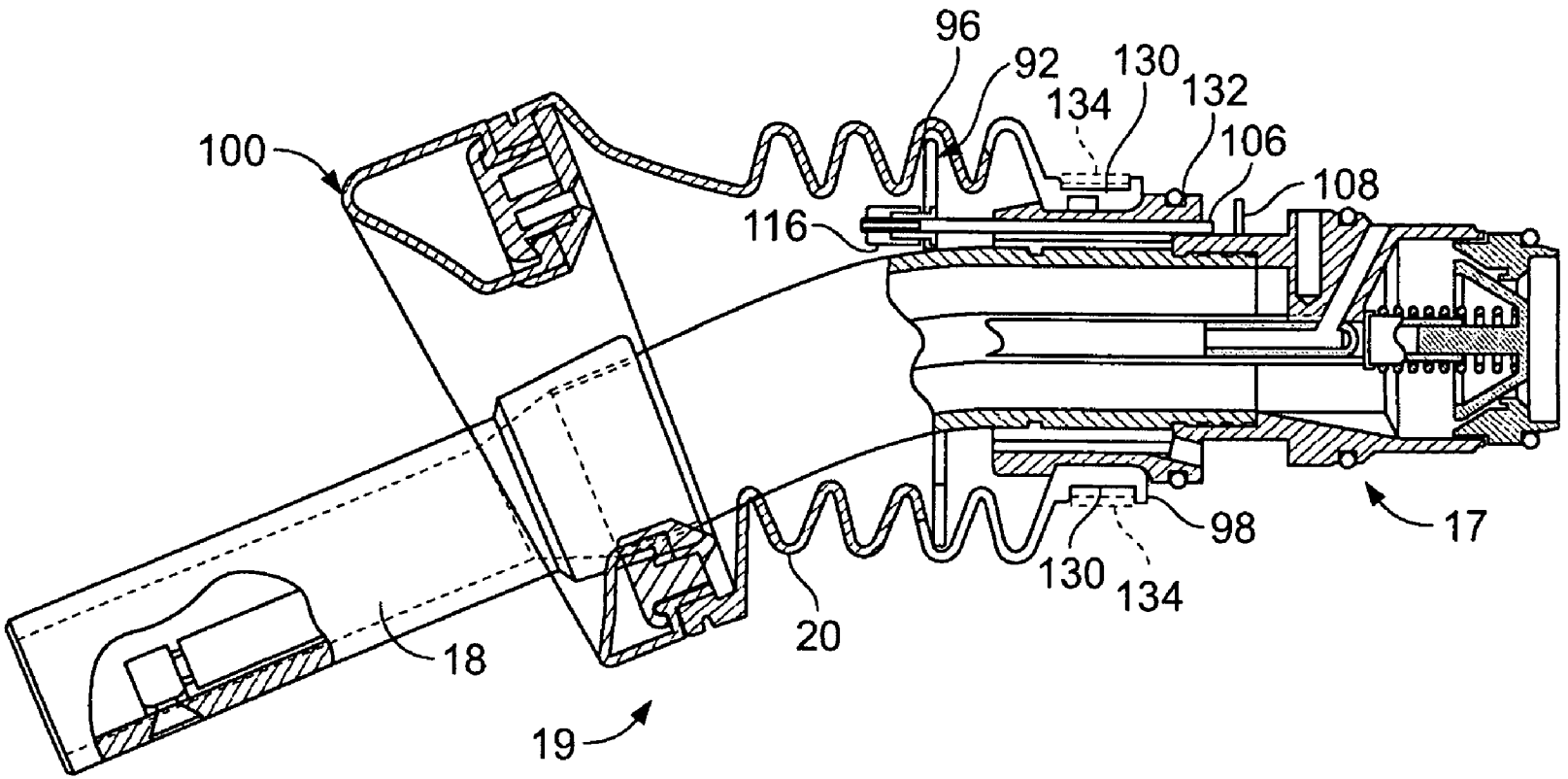
FIG. 16 is a similar side section view of the replacement boot assembly of FIG. 15 assembled to a spout assembly.

Referring now also to FIG. 16, installation of the boot assembly 19 upon the spout assembly 17 of a nozzle assembly 12 (FIG. 4) will now be further described. The lower push rod 106 of the linkage assembly 102 within the boot 20 is aligned to an angle between a punched hole in the hose clamp groove 130 to match the angle between the push rod 106 and the push rod hole 132 in the spout body. (A push rod hole checking tool may be used to verify that a clear hole condition exists in the spout body before proceeding.) The inner end of the lower push rod 106 is started into the hole 132, and then the boot 20 is slid axially into engagement with a locating pin (not shown) while preferably limiting angular rotation of the boot to ± about 5° in a clockwise or counterclockwise rocking motion as the boot is worked onto the spout assembly. Once the boot assembly is engaged over the end of the spout assembly, the boot can be fully rotated, as necessary, to its desired position, without rotation of the boot push plate loosely mounted with the boot. A hose clamp 134 is then installed and tightened, e.g. per factory standard, securing the boot to the spout. Installation is completed with verification that the nozzle assembly 12 will not operate with the dispenser 10 authorized and the boot 20 in free state, i.e. without the boot outer rim sealing surface 100 engaged with the surface surrounding the fill pipe, signaling insertion of the spout into a vehicle fill pipe, and with verification that the nozzle assembly 12 will operate with the dispenser authorized and the nozzle spout inserted into the vehicle fill pipe, F, to a position ⅛ inch short of latching condition.

A number of implementations have been described. Nevertheless, it will be understood that various modifications may be made without departing from the spirit and scope of the invention. For example, the lower push rod 106 may be mounted to the boot 20 by other means or at other locations, e.g. connection may be made to boot sealing surface 100 with an appropriate lost motion feature to accommodate the increased travel. Also, a sliding cam or crank-and-lifting beam structure may be employed in place of the lift cam. Accordingly, other embodiments are within the scope of the following claims.

What is claimed is:

1. A fuel dispensing nozzle, comprising a nozzle body with a liquid fuel delivery spout, the nozzle body and the spout together defining a passageway in communication with a hose connected to a fuel dispenser for delivery of liquid fuel from the dispenser, through the spout and into a fill pipe of a vehicle fuel tank;

a boot surrounding the spout and defining a boot outer rim disposed for engagement with a surface surrounding the fill pipe;

a fuel valve disposed within the nozzle body for starting and stopping flow of liquid fuel through the passageway, the fuel valve actuatable by an operating lever mounted to a forward pivot rod extending in telescoping relationship from a lower rod portion of a latch pin assembly, the latch pin assembly comprising a resilient diaphragm associated with the lower rod portion and disposed for movement between a first position resisting opening of the fuel valve and a second position permitting opening of the fuel valve;

an anti-spitting lockout assembly restricting movement of the diaphragm axially of the latch pin assembly from the first position resisting opening of the fuel valve for flow of liquid fuel through the passageway, the anti-spitting lockout assembly comprising a lift cam arm assembly mounted for movement in a plane generally parallel to the resilient diaphragm and perpendicular to the axis of the latch pin assembly, between a first, engaged position latching the latch pin assembly against axial movement, thereby to resist opening of the fuel valve, and a second, removed position permitting axial movement of the latch pin assembly, thereby to permit opening of the fuel valve; and a linkage assembly responsive to engagement of the boot outer rim with the surface surrounding a vehicle fill pipe, signaling insertion of the spout into the vehicle fill pipe, to trigger release of the anti-spitting lockout assembly, thereby to permit opening of fuel valve.

2. The fuel dispensing nozzle of claim 1, wherein the anti-spitting lockout assembly is adapted to resist opening of the fuel valve to permit flow of liquid fuel through the passageway to the spout until the boot outer rim is engaged with the surface surrounding the fill pipe, signaling insertion of the spout into a vehicle fill pipe, thereby to resist spitting of liquid fuel from the spout due to premature release of liquid fuel held under residual pressure in the hose.

3. The fuel dispensing nozzle of claim 1, wherein, in the presence of authorization of an associated fuel dispenser for delivery of liquid fuel to the fuel dispensing nozzle, the anti-spitting lockout assembly is adapted to resist opening of the fuel valve to permit flow of liquid fuel through the passageway to the spout until the boot outer rim is engaged with the surface surrounding the fill pipe, signaling insertion of the spout into a vehicle fill pipe, thereby to resist spitting of liquid fuel from the spout.

4. The fuel dispensing nozzle of claim 1 or claim 2 or claim 3, where the boot is axially-compressible, and compression of the boot by engagement of the boot outer rim with the surface surrounding the fill pipe by insertion of the spout into the fill pipe is communicated by the linkage mechanism to the anti-spitting lockout assembly to trigger release of the fuel valve.

5. The fuel dispensing nozzle of claim 4, wherein the boot defines a series of convolutions, and the linkage assembly comprises a boot push plate member disposed within a convolution of the boot.

6. The fuel dispensing nozzle of claim 5, wherein the linkage assembly further comprises linkage elements in communication between the boot push plate member and the lift cam arm for triggering movement of the lift cam arm between the first position and the second position due to movement of the plate member in response to compression of the boot when the boot rim is engaged with the surface surrounding the fill pipe, signaling insertion of the spout into a vehicle fill pipe.

7. The fuel dispensing nozzle of claim 6, wherein the lift cam arm is spring-biased toward the first, lockout position.

8. The boot assembly of claim 5, wherein said boot push plate member is loosely mounted in said axially-compressible boot, in a manner to permit rotational adjustment of the boot relative to the boot push plate member.

9. The boot assembly of claim 8, wherein said boot is fully rotatable relative to the boot push plate and to the associated nozzle.

10. The boot assembly of claim 5, wherein the linkage assembly further comprises a connecting push plate member mounted for communication between linkage elements of said boot and linkage elements of the fuel dispensing nozzle.

11. A fuel dispenser assembly, comprising:

a fuel dispenser in communication with a source of liquid fuel, a fuel dispensing nozzle, and a hose in communication between the fuel dispenser and the fuel dispensing nozzle for delivery of liquid fuel from the fuel dispenser to the fuel dispensing nozzle, a nozzle body with a liquid fuel delivery spout, the nozzle body and the spout together defining a passageway in communication with a hose connected to a fuel dispenser for delivery of liquid fuel from the dispenser, through the spout and into a fill pipe of a vehicle fuel tank;

a boot surrounding the spout and defining a boot outer rim disposed for engagement with a surface surrounding the fill pipe;

a fuel valve disposed within the nozzle body for starting and stopping flow of liquid fuel through the passageway, the fuel valve actuatable by an operating lever mounted to a forward pivot rod extending in telescoping relationship from a lower rod portion of a latch pin assembly, the latch pin assembly comprising a resilient diaphragm associated with the lower rod portion and disposed for movement between a first position resisting opening of the fuel valve and a second position permitting opening of the fuel valve;

an anti-spitting lockout assembly restricting movement of the diaphragm axially of the latch pin assembly from the first position resisting opening of the fuel valve for flow of liquid fuel through the passageway, the anti-spitting lockout assembly comprising a lift cam arm assembly mounted for movement in a plane generally parallel to the resilient diaphragm and perpendicular to the axis of the latch pin assembly, between a first, engaged position latching the latch pin assembly against axial movement, thereby to resist opening of the fuel valve, and a second, removed position permitting axial movement of the latch pin assembly, thereby to permit opening of the fuel valve; and a linkage assembly responsive to engagement of the boot outer rim with the surface surrounding a vehicle fill pipe, signaling insertion of the spout into the vehicle fill pipe, to trigger release of the anti-spitting lockout assembly, thereby to permit opening of fuel valve.

12. The fuel dispenser assembly of claim 11, wherein the anti-spitting lockout assembly is adapted to resist opening of the fuel valve for flow of liquid fuel through the passageway toward the spout until the boot outer rim is engaged with the surface surrounding the fill pipe, signaling insertion of the spout into a vehicle fill pipe, thereby to resist spitting of liquid fuel from the spout due to premature release of liquid fuel held under residual pressure in the hose.

13. The fuel dispensing nozzle of claim 11, wherein, in the presence of authorization of an associated fuel dispenser for delivery of liquid fuel to the fuel dispensing nozzle, the anti-spitting lockout assembly is adapted to resist opening of the fuel valve to permit flow of liquid fuel through the passageway to the spout until the boot outer rim is engaged with the surface surrounding the fill pipe, signaling insertion of the spout into a vehicle fill pipe, thereby to resist spitting of liquid fuel from the spout.

14. The fuel dispenser assembly of claim 12 or claim 13, where the boot is axially-compressible, and compression of the boot by engagement of the boot outer rim with the surface surrounding the fill pipe by insertion of the spout into the fill pipe is communicated by the linkage mechanism to the anti-spitting lockout assembly to trigger release of the fuel valve.

15. The fuel dispenser assembly of claim 14, wherein the boot defines a series of convolutions, and the linkage assembly comprises a boot push plate member disposed within a convolution of the boot.

16. The fuel dispenser assembly of claim 14, wherein the linkage assembly further comprises linkage elements in communication between the boot push plate member and the lift cam arm for triggering movement of the lift cam arm between the first position and the second position due to movement of the boot push plate member in response to compression of the boot when the boot outer rim is engaged with the surface surrounding the fill pipe, signaling insertion of the spout into a vehicle fill pipe.

17. The fuel dispenser assembly of claim 16, wherein the lift cam arm is spring-biased toward the first, lockout position.

18. The fuel dispenser assembly of claim 16, wherein the linkage elements comprise a connecting push plate member mounted for communication between linkage elements of the boot and linkage elements of the fuel dispensing nozzle.

19. The fuel dispenser assembly of claim 18, wherein the connecting push plate member is pivotably mounted to the spout assembly.

* * * * *